US006866940B1

(12) United States Patent
Laughlin

(10) Patent No.: US 6,866,940 B1
(45) Date of Patent: Mar. 15, 2005

(54) DECORATIVE ORNAMENT

(76) Inventor: Harold Patrick Laughlin, 1314 Hickory Dr., Basking Ridge, NJ (US) 07920

( * ) Notice: Subject to any disclaimer, the term of this patent is extended or adjusted under 35 U.S.C. 154(b) by 0 days.

(21) Appl. No.: 10/431,932

(22) Filed: May 8, 2003

(51) Int. Cl.[7] ..... A47G 29/00; A47G 1/16

(52) U.S. Cl. ..... 428/542.2; 428/913.3; 248/220.22; 248/225.11; 248/225.21; 248/491; 248/497; 248/339

(58) Field of Search ..... 248/491, 497, 248/339, 220.21, 220.41, 220.42, 220.43, 220.22, 224.7, 225.11, 225.21; 428/913.3, 542.2

(56) References Cited

U.S. PATENT DOCUMENTS 4,068,817 A * 1/1978 Berger ..... 248/340
5,524,853 A * 6/1996 Varlaro ..... 248/145
D440,026 S * 4/2001 Barney ..... D99/30
6,640,395 B2 * 11/2003 Bush ..... 24/68 CD
D484,668 S * 12/2003 Morgan et al. ..... D99/29

* cited by examiner

*Primary Examiner*—Elizabeth M. Cole
*Assistant Examiner*—A B Sperty
(74) *Attorney, Agent, or Firm*—Gold & Rizvi, P.A.; H. John Rizvi; Glenn E. Gold

(57) ABSTRACT

A decorative ornament which may be attached to a shutter, wall, door, fence or other structure typically outside a home or business to enhance the appearance of the structure or to express seasonal, holiday, scholastic or other sentiment. The decorative ornament includes an ornament mount block which removably engages the structure. An ornament body which is shaped in the configuration of a flower or other selected design is removably attached to the ornament mount block typically using brackets. In one embodiment, a hook mount spring is provided on the ornament mount block. A pair of hooks terminate respective ends of the hook mount spring for removably engaging louvers or slats on a shutter, for example, or other elements on an alternative structure. In another embodiment, the ornament mount block may be attached to the structure using fasteners such as screws.

8 Claims, 3 Drawing Sheets

DECORATIVE ORNAMENT

BACKGROUND OF THE INVENTION

1. Field of the Invention

The present invention relates generally to decorative ornaments for structures such as doors, walls, shutters and the like. More particularly, the present invention relates to a decorative ornament which is simple in construction and is suitably adapted for removable attachment to a shutter or other structure.

2. Description of the Prior Art

Shutters are commonly used on the exteriors of houses and commercial buildings to impart a pleasing aesthetic appearance to the houses or buildings and/or to selectively block the emission of sunlight or other exterior light through windows. Shutters typically include a generally rectangular frame which supports multiple horizontally-spanning and parallel louvers. In functional shutters, the louvers are mounted on a rotatable tilt rod and are capable of concerted pivoting between open and closed positions adjacent to the surface of a window to selectively emit or block sunlight or other exterior lighting through the window. In decorative shutters, the louvers are typically fixedly mounted in a downwardly-angled position. The decorative shutters are typically mounted on the exterior wall of a house or building on respective sides of a window to improve the appearance of the home or building exterior.

Decorative shutters significantly improve the exterior appearance of homes or other buildings. However, it would be desirable to provide ornaments which may be removably attached to a shutter at selected positions thereon to decorate and enhance the aesthetic appearance of the shutters for such occasions as birthday parties; holidays or for seasonal, weather-related, regional, geographic or scholastic celebrations. Accordingly, the present invention provides a decorative ornament which may be attached to shutters, walls, doors, fences and the like for a variety of decorative purposes.

SUMMARY OF THE INVENTION

The present invention is directed to a decorative ornament which has a simple construction and may be easily attached to a standard window shutter or to an exterior wall, door, fence or other structure of a home or business to improve the aesthetic appearance of the structure to which the decorative ornament is attached or to express celebratory, seasonal, scholastic, or other sentiment.

An object of the present invention is to provide a decorative ornament that is characterized by ease of installation and which improves the aesthetic appearance of a structure such as an exterior shutter, wall, door or fence of a home or business.

Another object of the present invention is to provide a decorative ornament which is suitable for birthday, holiday, seasonal, geographic, scholastic, or other expressions.

Still another object of the present invention is to provide a decorative ornament which may be quickly and easily mounted to a structure.

Yet another object of the present invention is to provide a decorative ornament which may be removably attached to a structure such as a shutter on the interior or exterior of a home, business or other building.

Yet another object of the present invention is to provide an aesthetically-pleasing decorative ornament which may be constructed of any of a variety of materials such as wood, plastic or metal.

A still further object of the present invention is to provide a decorative ornament which may be mounted on a shutter or other structure using brackets or other fasteners.

Another object of the present invention is to provide a decorative ornament which may be mounted in selected positions on a shutter without modification of the shutter.

Yet another object of the present invention is to provide a decorative ornament which includes an ornament body fitted with spring-loaded hooks for removably engaging louvers on a shutter.

A still further object of the present invention is to provide a decorative ornament which includes an ornament body having a selected decorative configuration for decorating a structure such as an exterior shutter, wall, door or fence.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION OF THE PREFERRED EMBODIMENTS

Shown throughout the drawings, the present invention is generally directed towards a decorative ornament that is simple in design and is particularly adapted to be removably mounted on a shutter to enhance the aesthetic appearance of the shutter or to express celebratory sentiments or the like, and is also capable of attachment to other structures such as walls, doors or fences.

Figure 2:
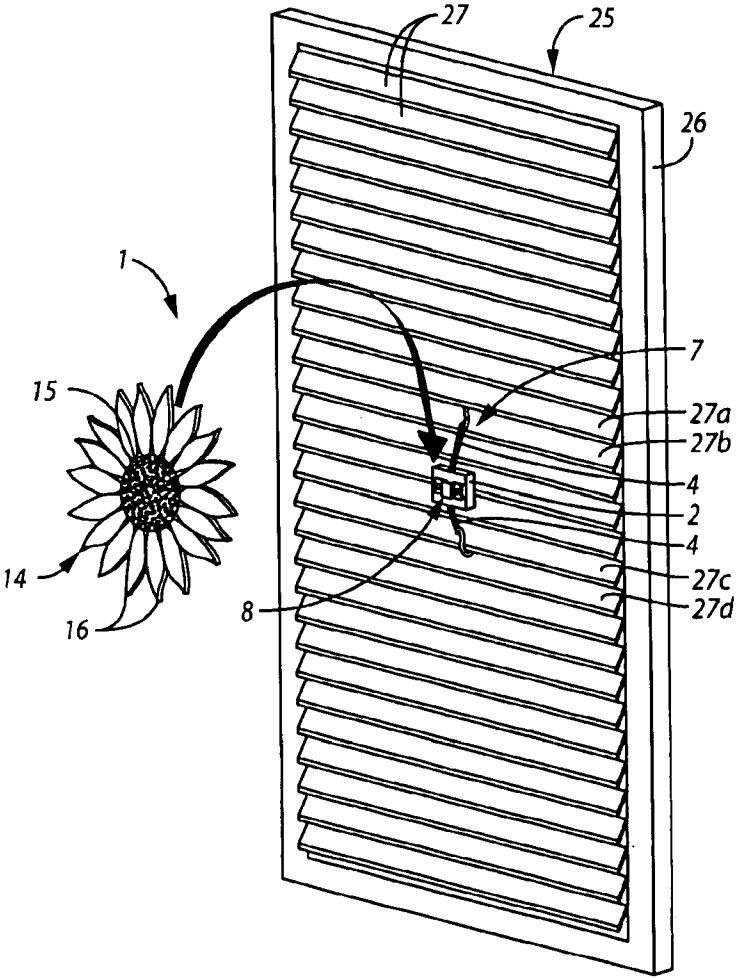
FIG. 2 is a front perspective view of a shutter, with a mounting assembly element of the decorative ornament of the present invention attached to the shutter and a flower-shaped ornament body element of the decorative ornament removed from the mounting assembly.
Figure 1:
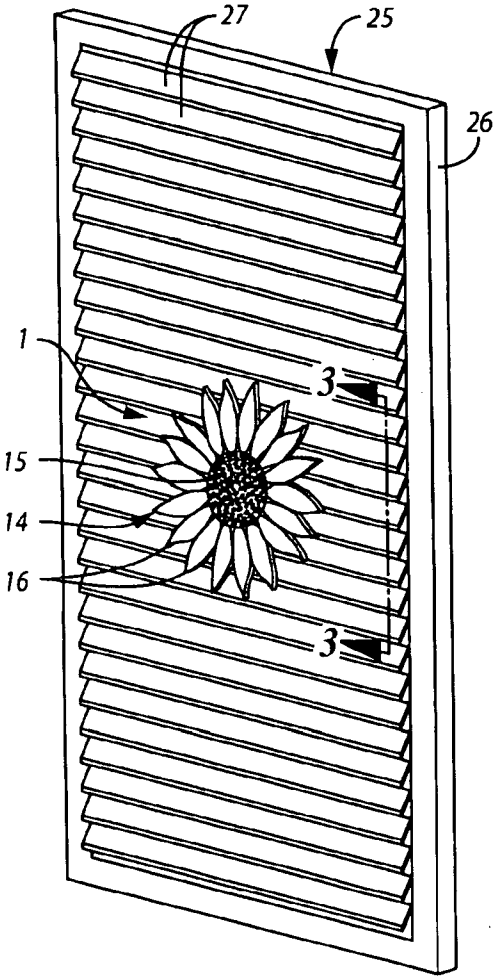
FIG. 1 is a front perspective view of a shutter, with a preferred embodiment of the decorative ornament of the present invention attached to the shutter.

Referring initially to FIGS. 1 and 2, a preferred embodiment of a decorative ornament of the present invention is generally indicated by reference numeral 1 and is suitable for removable attachment to a shutter 25 which is typically mounted on the exterior wall of a house or building (not shown) adjacent to a window (not shown). While it may have any of a variety of characteristics, the shutter 25 typically includes a continuous rectangular frame 26 and multiple louvers or slats 27 which horizontally span the frame 26 in parallel, adjacent and typically overlapping relationship to each other. The slats 27 typically angle downwardly from the rear to the front edge of each, as shown. The shutter 25 may be wood, plastic or metal and is typically painted a color which matches the wooden or brick exterior of the house or building on which the shutter 25 is mounted. Each shutter 25 is typically symmetrically paired with a shutter 25 of like design and appearance on opposite sides of a window in the house or building.

Figure 4:
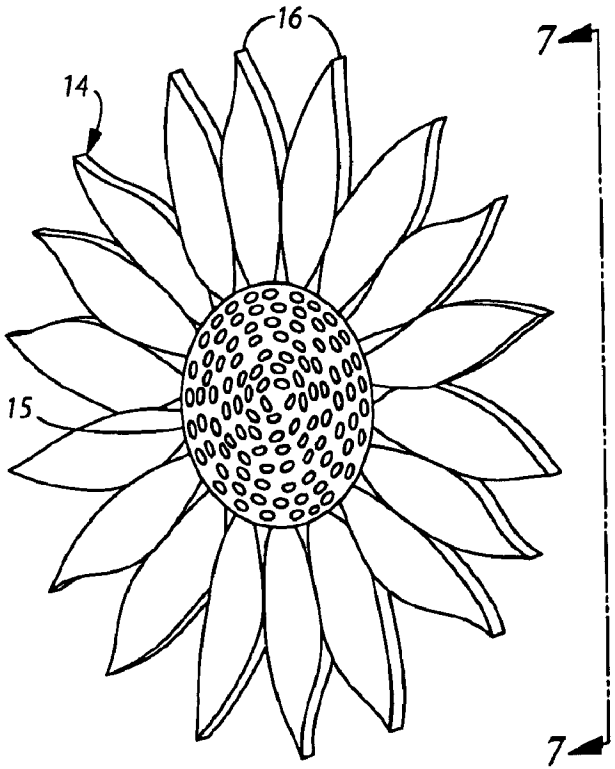
FIG. 4 is a front perspective view of a flower-shaped ornament body for the decorative ornament in a preferred embodiment of the invention.
Figure 6:
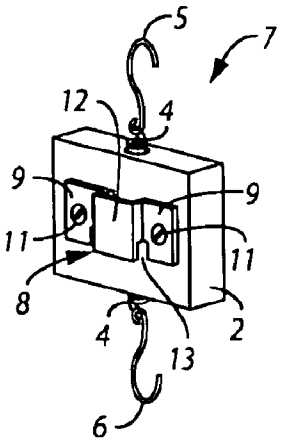
FIG. 6 is a front perspective view of the mounting assembly shown in FIG. 5.
Figure 5:
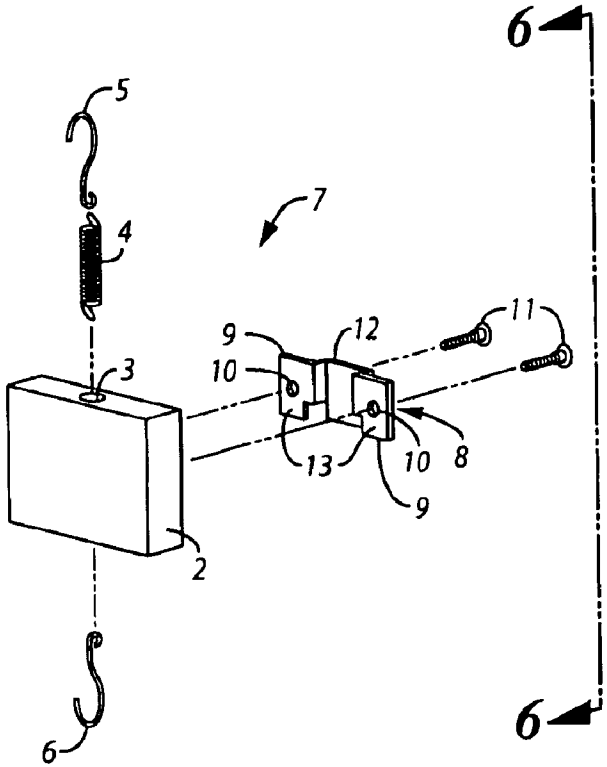
FIG. 5 is an exploded, rear perspective view of a mounting assembly used in a preferred embodiment to mount the ornament body of the decorative ornament on a shutter.

Referring next to FIGS. 4–7, in a preferred embodiment the decorative ornament 1 includes a mounting assembly 7 (FIGS. 5 and 6) which is removably attached to the shutter 25, and an ornament body 14 (FIGS. 4 and 7) which is removably attached to the mounting assembly 7, in the manner shown in FIGS. 1–3 and hereinafter described. As shown in FIGS. 5 and 6, the mounting assembly 7 includes a typically rectangular ornament mount block 2 which is typically constructed of wood, metal or plastic. A spring opening 3 extends vertically through the ornament mount block 2, and a coiled hook mount spring 4 extends through the spring opening 3. A top mount hook 5 is attached to one end, and a bottom mount hook 6 is attached to the opposite end, of the hook mount spring 4. In use, as hereinafter described, the top mount hook 5 and the bottom mount hook 6 engage respective louvers or slats 27 on the shutter 25 to removably mount the mounting assembly 7 on the shutter 25. An elongated mount block bracket 8 includes a pair of bracket flanges 9, each of which has a screw opening 10. A middle engaging portion 12 connects the bracket flanges 9 of the mount block bracket 8 to each other, and is typically offset with respect to the bracket flanges 9. A bracket slot 13 is further provided in the bottom edge of the mount block bracket 8, typically at the junction of each bracket flange 9 with the engaging portion 12, for purposes which will be hereinafter described. As shown in FIGS. 5 and 6, the mount block bracket 8 is mounted on the front surface of the ornament mount block 2 typically by extending a screw 11 through the screw opening 10 of each bracket flange 9 and threading each screw 11 into a corresponding registering screw opening (not shown) provided in the ornament mount block 2.

Figure 7:
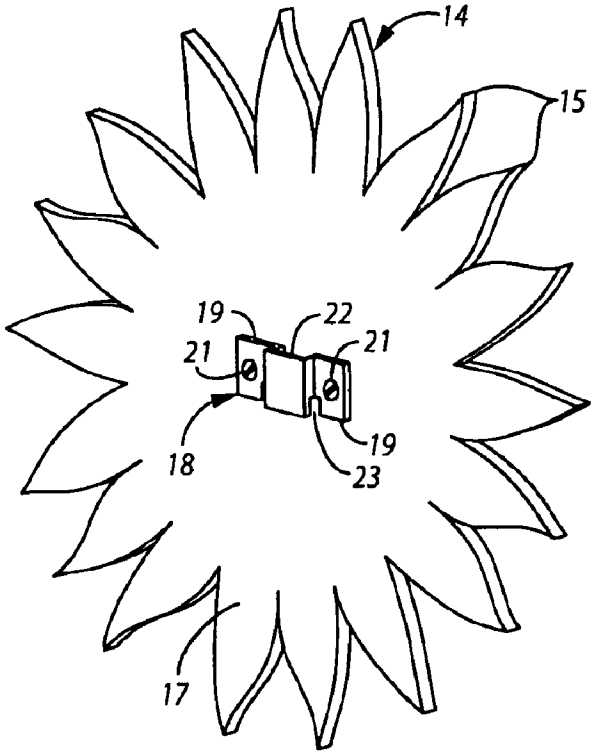
FIG. 7 is a rear perspective view of a flower-shaped ornament body of the decorative ornament, with an ornament bracket provided on the rear surface of the ornament body for engaging the mounting assembly shown in FIGS. 5 and 6.

As shown in FIGS. 4 and 7, in a preferred embodiment the ornament body 14 is shaped in the configuration of a sunflower having a flower center 15 and multiple flower petals 16 extending outwardly therefrom. However, it is understood that the flower-shaped ornament body 14 shown in the drawings serves as just one example of an ornament body which is suitable for the present invention, and the ornament body may have alternative shapes and appearances bearing the likeness of other plants or flowers, animals or the insignias of schools or universities, for example. The ornament body 14 may be constructed of wood such as pine, cedar or birch; a plastic material; or a metal such as copper, tin or brass, for example, or any other suitable weather-resistant material suitable for outdoor display. As shown in FIG. 7, the ornament body 14 includes a rear surface 17, on which is mounted an ornament bracket 18. The ornament bracket 18 may have substantially the same structure as that of the mount block bracket 8 heretofore described with respect to FIGS. 5 and 6, and typically includes a pair of bracket flanges 19 connected by an offset engaging portion 22. A bracket slot 23 is provided in the bottom edge of the ornament bracket 18, typically at the junction of each bracket flange 19 with the engaging portion 22. The ornament bracket 18 is mounted to the rear surface 17 of the ornament body 14 typically by extending screws 21 through screw openings (not shown) provided in the respective bracket flanges 19 and threading the screws 21 into respective screw openings (not shown) provided in the ornament body 14. Accordingly, the ornament bracket 18 on the ornament body 14 is capable of removably engaging the mount block bracket 8 of the mounting assembly 7, in the manner hereinafter described, to removably mount the ornament body 14 on the mounting assembly 7.

Figure 3:
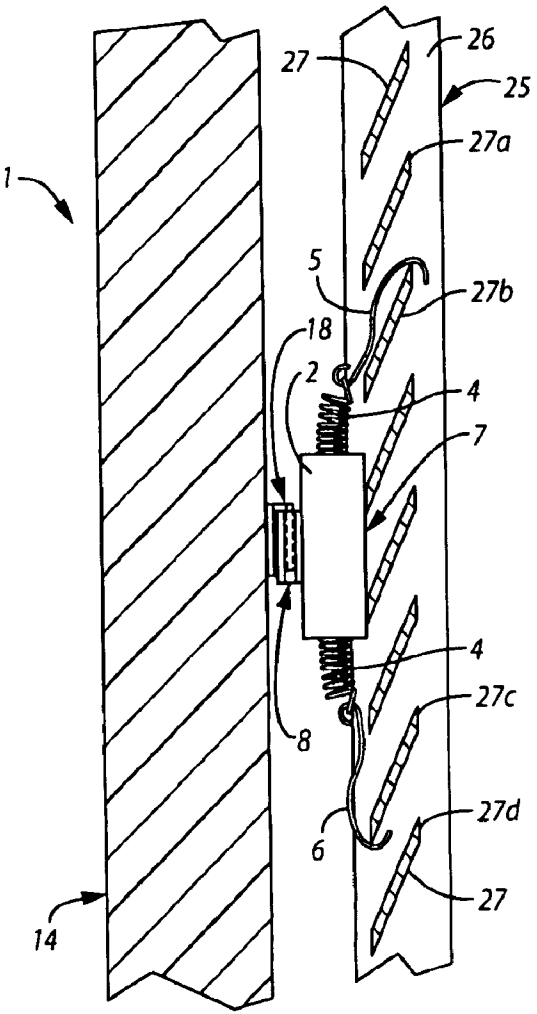
FIG. 3 is a sectional view, taken along cutting plane 3—3 in FIG. 1, more particularly illustrating a preferred technique for removably mounting the decorative ornament on a shutter.

Referring next to FIGS. 1–3, in typical application the decorative ornament 1 is removably attached to the shutter 25 in the following manner. First, the mounting assembly 7, with the ornament body 14 typically detached therefrom, is attached to the shutter 25 as shown in FIGS. 2 and 3, by initially extending the top mount hook 5 between a pair of adjacent slats 27*a* and 27*b* of the shutter 25 and then causing engagement of the top mount hook 5 with the rear edge of the lower slat 27*b* of the the adjacent slats 27, as particularly illustrated in FIG. 3. Next, the bottom mount hook 6 is pulled downwardly against tension imparted by the coiled hook mount spring 4 and then inserted between a pair of the adjacent slats 27*c* and 27*d* and engaged with the front edge of the upper slat 27*c* of the adjacent slats 27. Accordingly, as shown in FIG. 2 the ornament mount block 2 is positioned with the mount block bracket 8 facing forwardly for subsequent mounting of the ornament body 14 on the mounting assembly 7. Because the hook mount spring 4 is stretched into a taut configuration, the top mount hook 5 firmly engages the shutter slat 27*b* and the bottom mount hook 6 firmly engages the shutter slat 27*c* to securely mount the ornament mount block 2 on the shutter 25.

After the mounting assembly 7 is attached to the shutter 25 in the manner heretofore described, the ornament body 14 is removably mounted on the ornament mount block 2 of the mounting assembly 7. This is accomplished by causing engagement of the bracket slots 23 (FIG. 7) of the ornament bracket 18 on the ornament body 14 with the offset engaging portion 12 (FIG. 6) of the mount block bracket 8 on the ornament mount block 2. In this manner, the ornament bracket 18 and the mount block bracket 8 are positioned in interlocking relationship with respect to each other, as shown in FIG. 3, with the ornament bracket 18 functioning as the "female" bracket element and the mount block bracket 8 functioning as the complementary "male" bracket element. The mount block bracket 8 thus supports the weight of the ornament body 14 on the ornament mount block 2.

It is understood that the mounting assembly 7 heretofore described in detail with respect to FIGS. 5 and 6 is just one example of a technique which can be used to mount the ornament body 14 on the shutter 25. The ornament body 14 may be mounted on non-louvered shutters or other structures such as an exterior door or wall (not shown) by the use of threaded fasteners such as screws (not shown) which may be extended through preformed holes (not shown) in the ornament mount block 2 and threaded into registering fastener openings (not shown) provided in the structure to which the decorative ornament 1 is to be mounted.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

I claim:

1. A decorative ornament for attachment to a structure, comprising:

an ornament mount block having a spring opening extending through said ornament mount block;

a hook mount spring extending through said spring opening of said ornament mount block;

a hook attached to said hook mount spring for engaging the structure; and an ornament body attached to said ornament mount block.

2. The decorative ornament of claim 1 wherein said ornament body is shaped in a configuration of a flower.

3. The decorative ornament of claim 1 further comprising an ornament bracket attached to said ornament body for removably engaging said ornament mount block.

4. The decorative ornament of claim 3 wherein said ornament body is shaped in a configuration of a flower.

5. The decorative ornament of claim 1 wherein said hook is attached to a first end of said hook mount spring and further comprising a second hook attached to a second end of said hook mount spring.

6. The decorative ornament of claim 5 wherein said ornament body is shaped in a configuration of a flower.

7. The decorative ornament of claim 5 further comprising an ornament bracket attached to said ornament body for removably engaging said ornament mount block.

8. The decorative ornament of claim 7 wherein said ornament body is shaped in a configuration of a flower.

* * * * *